US012037743B2

(12) United States Patent
Parthasarathy

(10) Patent No.: US 12,037,743 B2
(45) Date of Patent: Jul. 16, 2024

(54) ADVANCEMENT OF EXHAUSTION, MIGRATION, ADSORPTION AND FIXATION OF DYESTUFF TO THE CELLULOSE MATERIALS

(71) Applicant: Prabhakaran Parthasarathy, Tamilnadu (IN)

(72) Inventor: Prabhakaran Parthasarathy, Tamilnadu (IN)

( * ) Notice: Subject to any disclaimer, the term of this patent is extended or adjusted under 35 U.S.C. 154(b) by 371 days.

(21) Appl. No.: 17/293,725

(22) PCT Filed: Oct. 11, 2019

(86) PCT No.: PCT/IN2019/000032
§ 371 (c)(1),
(2) Date: May 13, 2021

(87) PCT Pub. No.: WO2020/100153
PCT Pub. Date: May 22, 2020

(65) Prior Publication Data

US 2022/0002940 A1 Jan. 6, 2022

(30) Foreign Application Priority Data

Nov. 14, 2018 (IN) ..... 201841042721

(51) Int. Cl.

| | |
|---|---|
| ***D06P 5/00*** | (2006.01) |
| ***D06P 1/38*** | (2006.01) |
| ***D06P 1/62*** | (2006.01) |
| ***D06P 1/647*** | (2006.01) |
| ***D06P 1/649*** | (2006.01) |
| ***D06P 1/651*** | (2006.01) |
| ***D06P 1/673*** | (2006.01) |
| ***D06P 1/96*** | (2006.01) |
| ***D06P 3/66*** | (2006.01) |

(52) U.S. Cl.
CPC ..... *D06P 5/002* (2013.01); *D06P 1/38* (2013.01); *D06P 1/628* (2013.01); *D06P 1/647* (2013.01); *D06P 1/6491* (2013.01); *D06P 1/65125* (2013.01); *D06P 1/67341* (2013.01); *D06P 1/67366* (2013.01); *D06P 1/96* (2013.01); *D06P 3/66* (2013.01)

(58) Field of Classification Search
CPC .. D06P 5/002; D06P 1/38; D06P 1/628; D06P 1/647; D06P 1/6491; D06P 1/65125; D06P 1/67341; D06P 1/67366; D06P 1/96; D06P 3/66
See application file for complete search history.

(56) References Cited

U.S. PATENT DOCUMENTS 4,645,510 A * 2/1987 Hasler ..... D06P 3/66 8/534

FOREIGN PATENT DOCUMENTS

| | | |
|---|---|---|
| CN | 103526606 A | 1/2014 |
| CN | 102978952 B | 5/2015 |

* cited by examiner

*Primary Examiner* — Amina S Khan
(74) *Attorney, Agent, or Firm* — Stein IP, LLC

(57) ABSTRACT

The present invention relates to a method of dyeing using a salt mixture as an electrolyte with 0.5 to 5.00 GPL of sodium chloride or sodium sulphate and alkali agents I and II to exhaust and fix a dyestuff to a cellulose material in a reactive dyeing. In the method the cellulose fiber is treated with (i) the salt mixture with sodium chloride or sodium sulphate specifically, putting the pre-treated fiber maintained at a pH between 3 and above and an (MLR) maintained between 1:20 and 1:3 at a temperature between 20° C. and above and exhausted for between 15 minutes and above, (ii) the alkali agent I with a pH between 9.5 and above at a temperature between 30° C. and above and stained for between 20 minutes and above (iii) the alkali agent II with a pH between 10.5 and above at a temperature between 30° C. and above and stained for 40 minutes and above.

3 Claims, 12 Drawing Sheets

Figure 1:
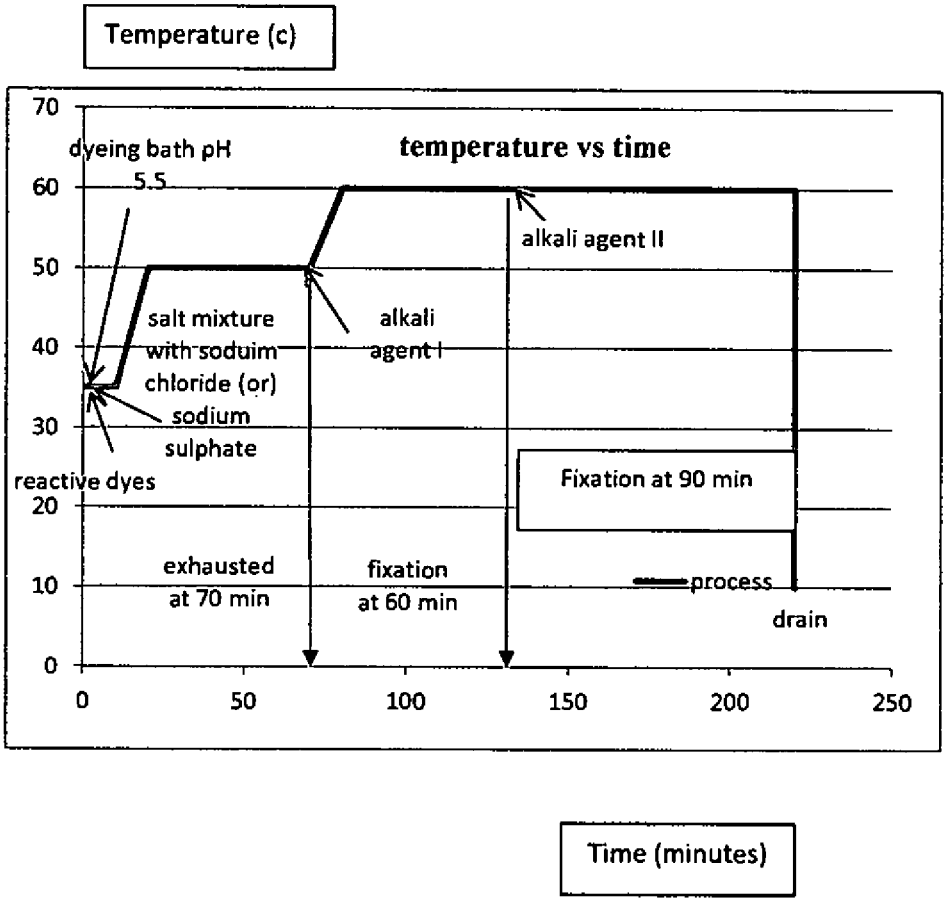

ADVANCEMENT OF EXHAUSTION, MIGRATION, ADSORPTION AND FIXATION OF DYESTUFF TO THE CELLULOSE MATERIALS

CROSS-REFERENCE TO RELATED APPLICATIONS

This application is a national stage of International Application No. PCT/IN2019/000032, filed Oct. 11, 2019, which claims the benefit of Indian Application No. 201841042721, filed Nov. 14, 2018, in the Indian Patent Office, the disclosures of which are incorporated herein by reference.

TECHNICAL FIELD

The present invention relates to the method of reactive dyeing using salt mixture as an electrolyte to provide the affinity of the dyestuff, acceleration of the dyestuff association and exhaustion of dyestuff for migration and adsorption with alkali agents I and II to provide fixation of the dyestuff to the cellulose materials.

BACKGROUND

Salts and alkalis are unavoidable ones in dyeing industry. They are used to provide affinity, acceleration, migration, adsorption and fixation of the dyestuff to the cellulose materials. The absence of salt brings repulsion between the cellulose materials and the dye. Large quantities of electrolyte are added to overcome the problem. The requirement of a large amount of electrolyte leads to environmental problems. In addition, inadequate dye exhaustion and fixation result in coloured effluents. Usually the textile dyeing industry is a water intensive industry with water being used in every stage of the dyeing. So every textile dyeing plant requires large volumes of water and produces high volumes of effluent wastewater. Further, the dye fixation potency on cellulose materials is low. It ends up in an extremely coloured dye effluent that is unfriendly to the environment. The concentration of salts (30-100 g/l) and alkali (5-20 g/l) might create further effluent issues. It might especially pollute the land or water bodies. Since TDS, TSS, COD, BOD, colour value, and water turbidity are high and additionally the consumption of energy, time and man power is also high. The need to reduce the amount of electrolyte, alkali, water, energy, time and manpower is crucial in every textile dyeing industry.

In order to solve the existing problems in using salts and alkalis, the present invention that is made relates to the method of dyeing with reactive dyes using the salt mixture as an electrolyte with 0.5-5 GPL of sodium chloride or sodium sulphate to provide exhaustion of dyestuff for migration and adsorption with alkali agents I and II to provide fixation of the dyestuff to the cellulose materials, provides excellent dyeing, perfect levelling property, lower COD, BOD, and TDS, less amount of water, energy, time and manpower and safe environment.

DESCRIPTION OF RELATED ARTS

The use of salts and alkalis in the textile dyeing industry is a significant one. Without salts and alkalis, there is no exhaustion and fixation of dyestuff to the cellulose materials respectively. So they are widely used in the industry to provide affinity, acceleration, migration, adsorption and fixation of dyestuff. But the large requirement of salts and alkalis leads to environmental problems. In addition, inadequate dye exhaustion and fixation result in coloured effluents. As a result, the range of TDS, TSS, COD, BOD, colour value and water turbidity is very high and additionally the consumption of water, energy, time and man power is also high.

To protect the environment and solve the existing problems in using the salts and alkalis, the present invention which is made on low salts and alkalis with reactive dyes using the salt mixture as an electrolyte with 0.5-5 GPL of sodium chloride or sodium sulphate to provide exhaustion of dyestuff for migration and adsorption with alkali agents I and II to provide fixation of the dyestuff to the cellulose materials, provides excellent dyeing, perfect levelling property, lower COD, BOD and TDS, less consumption of water, energy, time and manpower and safe environment.

The disclosed invention herein is an application of salt mixture with alkali agents I and II, a proven method in dyeing with reactive dyes which is known as "Advancement of exhaustion, migration, adsorption and fixation of dyestuff to the cellulose materials"

Conventionally, Enrichment of the affinity of dyestuff in the method of reactive dyeing using low salts' for instance, publication number 201741003740 1 Feb. 2017 discloses an invention related to the method of dyeing using the inventive mixture with an alkaline agent in reactive dyeing comprising the following salts (parts by weight formulation ratio basis)

A. 0.5-5 parts of sodium chloride

B. 0.25-6 parts of sodium nitrate

C. 0.02-5 parts of nitrogen

D. 0.03-4 parts of phosphate

E. 0.01-2 parts of calcium chloride

G. 0.001-1.5 parts of manganese sulphate

In 3-100 parts of deionised water provides dyeing wherein, the fabric is treated with the inventive mixture specifically, putting the pre-treated fabric maintained with a pH between 3 and above and an (MLR) maintained between 1:20 and 1:3 at a temperature between 20° C. and above and stained for between 15 minutes and above with an alkaline agent further provides the affinity of dyestuff, the acceleration of the dyestuff association and lowering of its solubility, the use as an electrolyte for migration, adsorption and fixation of the dyestuff, maximum pollution free environment and levelling property very well.

Furthermore, a few inventions in the past based on 'Cationzation composite modification method of pure cotton fabric' for instance publication number C N102505475B filling date 28 Oct. 2011 discloses a compound modified cationized cotton fabric, which belongs to the field of textile printing and dyeing pre-treatment. Wherein: the first through the chitosan modified cotton fabric processing, then by quaternary ammonium modification; or: cotton fabric will go through a quaternary ammonium modification, and then modified by chitosan deal with. The present invention, by using a complex type of cotton fabric with cationic modification agent treatment, the cotton fabric dyeing acceleration under no salt or low salt concentration conditions promote dye staining results can be obtained than the traditional dyeing process, reducing the dyeing wastewater salt content; good for the environment is a cotton fabric treatment process.

Furthermore, a few inventions in the past based on 'Cellulosic fiber fabric reactive dye salt—free deep—colour dyeing method' for instance publication number CN 103074766 A filed 9 Jan. 2013 discloses the invention related to a cellulosic fiber fabric reactive dye salt-free deep-color dyeing method, which comprises the following steps: (1) preparing a modifier aqueous solution, increasing the temperature to 60-80 DEG C., adding a test sample, stirring, adding sodium hydroxide, stirring, washing and drying to obtain a modifier test sample; and (2) adding a reactive dye and a levelling agent, increasing the temperature to 60-80 DEG C., adding the modifier test sample, dyeing for 20-30 minutes in a stirring manner, adding substitution alkali, dyeing for 30-45 minutes in a stirring and thermal insulation manner, decreasing the temperature to the room temperature, soaping, washing and oven drying. According to the invention, the modifier is used for modifying cellulosic fibers, so that the repulsive force between dye anions and fibers can be reduced, the purpose of fabric reactive dye salt-free dyeing can be achieved, the method is simple and convenient to operate, the effect is obvious, no additional equipment is required, and the cost is controllable.

SUMMARY

The object of the present invention in the method of dyeing with reactive dyes is to provide, i. exhaustion of dyestuff for migration and adsorption using the salt mixture comprising the following (weight percentage of content basis):

A. potassium chloride between 2% and 50%
B. diammonium phosphate between 0.5% and 18%
C. urea between 0.9% and 60%
D. sodium nitrate between 2.00% and 30%
E. calcium chloride between 0.02% and 7%
F. manganese sulphate between 0.10% and 5%
G. ETDA sodium between 0.002% and 7%
H. Ferrous sulphate between 0.10% and 10% and the balance water and a mixture thereof, ranging between 0.2 and 15 GPL (gram per litre) with 0.5 to 5 GPL of sodium chloride or sodium sulphate in reactive dyeing wherein the pre-treated cellulose material maintained with a pH 3 and above, at an (MLR) material-to-liquor ratio maintained between 1:20 and 1:3 at a temperature between 20° C. and above and exhausted for between 15 minutes and 90 minutes, ii. the fixation of dyestuff using alkali agent 1 comprising the following (weight percentage of content basis):

A. sodium bicarbonate between 2% and 40%
B. potassium bicarbonate between 0.5% and 15%
C. sodium carbonate between 10% and 90%
D. potassium carbonate between 2% and 70%
E. sodium acetate between 2% and 30%
F. ferrous sulphate between 0.1% and 5% and the balance water and a mixture thereof, ranging between 0.5 and 15 GPL (gram per litre) in reactive dyeing wherein the treated cellulose material maintained with a pH between 9.5 and above, at a temperature between 30° C. and above and stained for between 10 minutes and 60 minutes, iii. further, more fixation of dyestuff using alkali agent II comprising the following (weight percentage of content basis):

A. potassium hydroxide between 5% and 70%
B. calcium hydroxide between 1% and 50%
C. trisodium phosphate between 2% and 80%
D. sodium hydroxide between 0.1% and 20% and the balance water and a mixture thereof, ranging between 0.2 and 10 GPL (gram per litre) in reactive dyeing wherein the treated cellulose material maintained with the pH between 10.5 and above at a temperature between 30° C. and above and stained for 0:40 minutes and 120 minutes. Thus the dyeing is finished with neutralization, soaping, washing with hot water then water and at last drying. The object of the present invention is also to provide excellent dyeing, perfect levelling property, lower COD, BOD and TDS, less amount of water, energy, time and man power and safe environment.

DETAILED DESCRIPTION

The method of the present invention in the field of reactive dyeing using salt mixture as an electrolyte to provide exhaustion of dyestuff for migration and adsorption with alkali agents I and II to provide fixation of the dyestuff to the cellulose material comprises the following steps with the outcomes i. exhaustion of dyestuff for migration and adsorption using the salt mixture comprising the following (weight mass percentage of content basis):

A. potassium chloride between 2% and 50%
B. diammonium phosphate between 0.5% and 18%
C. urea between 0.9% and 60%
D. sodium nitrate between 2.00% and 30%
E. calcium chloride between 0.02% and 7%
F. manganese sulphate between 010% and 5%
G. ETDA sodium between 0.002% and 7%
H. Ferrous sulphate between 0.10% and 10% and the balance water and a mixture thereof, ranging between 0.2 and 15 GPL (gram per litre) with 0.5 to 3 GPL of sodium chloride or sodium sulphate in reactive dyeing wherein the pre-treated cellulose material maintained with a pH 3 and above, at an (MLR) material-to-liquor ratio maintained between 1:20 and 1:3 at a temperature between 20° C. and above and exhausted for between 15 minutes and 90 minutes, ii. the fixation of dyestuff using alkali agent I comprising the following (weight mass percentage of content basis):

A. sodium bicarbonate between 2% and 40%
B. potassium bicarbonate between 0.5% and 15%
C. sodium carbonate between 10% and 90%
D. potassium carbonate between 2% and 70%
E. sodium acetate between 2% and 30%
F. ferrous sulphate between 0.1% and 5% and the balance water and a mixture thereof, ranging between 0.5 and 15 GPL (gram per litre) in reactive dyeing wherein the treated cellulose material maintained with a pH between 9.5 and above, at a temperature between 30° C. and above and stained for between 10 minutes and 60 minutes, iii. further, more fixation of dyestuff using alkali agent II comprising the following (weight mass percentage of content basis):

A. potassium hydroxide between 5% and 70%
B. calcium hydroxide between 1% and 50%
C. trisodium phosphate between 2% and 80%
D. sodium hydroxide between 0.1% and 20% and the balance water and a mixture thereof, ranging between 0.2 and 10 GPL (gram per litre) in reactive dyeing wherein the treated cellulose material maintained with the pH between 10.5 and above at a temperature between 30° C. and above and stained for 40 minutes and 120 minutes. Thus the dyeing is finished with neutralization, soaping, washing with hot water then water and at last drying.

The present invention is also to provide excellent dyeing, perfect levelling property, lower COD, BOD and TDS, less consumption of water, energy, time and man power and safe environment.

EXAMPLES

The examples which follow illustrate the invention for a better understanding.

Example: 1

Staining Method

The raw materials for the dyeing process, including

Required pre-treated 100% cotton yarn

Reactive dyes: Yellow F3G: 0.8%, Turq blue G 266%: 1.8% and Blue HEGN: 1% on the weight of goods.

Salt mixture: 3.25 GPL

Sodium chloride: 2.00 GPL

Alkali agent I: 7 GPL

Alkali agent II: 2 GPL

Water Bath ratio: 1:5

Step,

A pre-treated 100% cotton yarn that is dyed with salt mixture as an electrolyte and sodium chloride to provide exhaustion of dyestuff for migration and adsorption and further alkali agents I and II to provide fixation of dyestuff to the cellulose material undergoes the steps of, (i) The dye bath is maintained with an (MLR) material to liquor ratio 1:5; at pH 6.5; next added with reactive H E dyes and 3.25 GPL of salt mixture with 2 GPL of sodium chloride at a temperature 70° C. and exhausted for 40 minutes.

(ii) Next added with 7 GPL of alkali agent I at a temperature 70° C. and stained for 40 minutes.

(iii) Again added with 2 GPL of alkali agent II at a temperature 75° C. and stained for 90 minutes.

The dye bath is removed and rinsed with warm water. After the acidic pH wash, the yarn is rinsed again with 1 GPL of soaping agent at a temperature 95° C. for 30 minutes. The soaping bath is removed. Then the cotton yarn is rinsed with hot water at a temperature 80° C. for 20 minutes twice. Finally it is washed well. At last checking of levelling, colour fastness to washing and colour fastness to rubbing is done. The results of the checking are very well.

Example: 2

Staining Method

The raw materials for dyeing process, including:

Required pre-treated 100% cotton fabric

Reactive dyes: Navy JB; 4.5%, Red GF; 0.75%, and Orange CE; 0.13% on the weight of goods Salt mixture: 2.75 GPL Sodium chloride: 2.00 GPL Alkali agent I: 7 GPL Alkali agent II: 3.25 GPL Bath ratio: 1:4

Step,

A pre-treated 100% cotton fabric that is dyed with salt mixture as an electrolyte and sodium chloride to provide exhaustion of dyestuff for migration and adsorption and further alkali agents I and II to provide fixation of dyestuff to the cellulose material undergoes the steps of, (i) The dye bath is maintained with an (MLR) material-to-liquor ratio 1:4; at pH 5.5; next added reactive dyes and 2.75 GPL of salt mixture with 2.00 GPL of sodium chloride at a temperature 50° C. and exhausted for 40 minutes.

(ii) Next added with 7 GPL of alkali agent I at a temperature 58° C. and stained for 40 minutes.

(iii) Again added with 3.25 GPL of alkali agent II at a temperature 58° C. and stained for 90 minutes.

The dye bath is removed and rinsed with warm water. After the acidic pH wash, the cotton fabric is rinsed again with 1 GPL of soaping agent at a temperature 95° C. for 30 minutes. The soaping bath is removed. Then the cotton fabric is rinsed with hot water at a temperature 80° C. for 20 minutes. Finally it is washed well. At last checking of levelling, colour fastness to washing and colour fastness to rubbing is done. The results of the checking are very well.

Example: 3

Staining Method

The raw materials for dyeing process, including:

Required pre-treated viscose fabric

Reactive dyes: Orange CE: 1.4%, Red GF: 3.1% and Navy JB: 0.2% on the weight of goods.

Salt mixture: 2.5 GPL

Alkali agent I: 9 GPL

Alkali agent II: 2.5 GPL

Bath ratio: 1:6

Step,

A pre-treated viscose fabric that is dyed with salt mixture as an electrolyte to provide exhaustion of dyestuff for migration and adsorption and further alkali agents 1 and II to provide fixation of dyestuff to the cellulose material undergoes the steps of, (i) The dye bath is maintained with an (MLR) material to liquor ratio 1:6; at pH 4.5; next added with bi and poly-functional reactive dyes (MCT-VS) and 2.5 GPL of salt mixture at a temperature 50° C. and exhausted for 40 minutes.

(ii) Next added with 9 GPL of alkali agent I at a temperature 60° C. and stained for 40 minutes.

(iii) Again added with 2.5 GPL of alkali agent II at a temperature 60° C. and stained for 90 minutes.

The dye bath is removed and rinsed with warm water. After the acidic pH wash, the viscose fabric is rinsed again with 1 GPL of soaping agent at a temperature 95° C. for 30 minutes. The soaping bath is removed. Then the viscose fabric is rinsed with hot water at a temperature 80° C. for 20 minutes twice. Finally it is washed well. At last checking of levelling, colour fastness to washing and colour fastness to rubbing is done. The results of the checking are very well.

Example: 4

Staining Method

The raw materials for dyeing process, including

Required pre-treated 100% cotton woven fabric

Reactive dyes: Yellow CE: 3.0%, Red CE: 0.100% and Blue CE: 0.045% on the weight of goods.

Salt mixture: 2.5 GPL

Sodium chloride: 3.00 GPL

Alkali agent I: 7 GPL

Alkali agent II: 3.5 GPL

Water Bath ratio: 1:8

Step,

A pre-treated cotton woven fabric that is dyed with salt mixture as an electrolyte and sodium chloride to provide exhaustion of dyestuff for migration and adsorption and further alkali agents I and II to provide fixation of dyestuff to the cellulose material undergoes the steps of, (i) The dye bath is maintained with an (MLR) material to liquor ratio 1:8; at pH 5.5; next added with reactive dyes and 2.5 GPL of salt mixture with 3 GPL of sodium chloride at a temperature 50° C. and exhausted for 50 minutes.

(ii) Next added with 7 GPL of alkali agent I at a temperature 60° C. and stained for 30 minutes.

(iii) Again added with 3.5 GPL of alkali agent II at a temperature 60° C. and stained for 60 minutes.

The dye bath is removed and rinsed with warm water. After the acidic pH wash, the cotton woven fabric is rinsed again with 1 GPL of soaping agent at a temperature 95° C. for 30 minutes. The soaping bath is removed. Then the cotton woven fabric is rinsed with hot water at a temperature 80° C. for 20 minutes. Finally it is washed well. At last checking of levelling, colour fastness to washing and colour fastness to rubbing is done. The results of the checking are very well.

Example: 5

Staining Method

The raw materials for dyeing process, including

Required pre-treated rayon yarn

Reactive dyes: Black SJ: 6.00%, Red CE: 0.350% and Yellow CE: 0.200% on the weight of goods.

Salt mixture: 15 GPL

Sodium carbonate: 7 GPL

Alkali agent II: 4.00 GPL

Water Bath ratio: 1:8

Step,

A pre-treated rayon yarn that is dyed with salt mixture as an electrolyte to provide exhaustion of dyestuff for migration and adsorption and further Sodium Carbonate with alkali agent II to provide fixation of dyestuff to the cellulose material undergoes the steps of, (i) The dye bath is maintained with an (MLR) material to liquor ratio 1:8; at pH 6.5; next added with reactive dyes and 3.5 GPL of salt mixture at a temperature 50° C. and exhausted for 30 minutes.

(ii) Next added with 7 GPL of sodium carbonate at a temperature 60° C. and for stained 50 minutes.

(iii) Again added with 4.00 GPL of alkali agent II at a temperature 60° C. and stained for 90 minutes.

The dye bath is removed and rinsed with warm water. After the acidic pH wash, the rayon yarn is rinsed again with 1 GPL of soaping agent at a temperature 95° C. for 30 minutes. The soaping bath is removed. Then the rayon yarn is rinsed with hot water at a temperature 80° C. for 20 minutes twice. Finally it is washed well. At last checking of levelling, colour fastness to washing and colour fastness to rubbing is done. The results of the checking are very well.

Example: 6

Staining Method

The raw materials for dyeing process, including

Required pre-treated cotton flax yarn

Reactive dyes: Blue HEGN: 6.3%, Blue HERD: 0.55% and Red H E3B: 0.65% on the weight of goods.

Salt mixture: 3.5 GPL

Sodium carbonate: 10 GPL

Alkali agent II: 3.5 GPL

Water Bath ratio: 1:10

Step,

A pre-treated cotton flax yarn that is dyed with salt mixture as an electrolyte to provide exhaustion of dyestuff for migration and adsorption and further Sodium Carbonate with alkali agent II to provide fixation of dyestuff to the cellulose material undergoes the steps of, (i) The dye bath is maintained with an (MLR) material to liquor ratio 1:10; at a pH 5.5; next added with reactive H E dyes and 3.5 GPL of salt mixture at a temperature 70° C. and exhausted for 30 minutes.

(ii) Next added with 10 GPL of sodium carbonate at a temperature 80° C. and stained for 30 minutes.

(iii) Again added with 3.5 GPL of alkali agent II at a temperature 80° C. and stained for 90 minutes.

The dye bath is removed and rinsed with warm water. After the acidic pH wash, the cotton flax yarn is rinsed again with 1 GPL of soaping agent at a temperature 95° C. for 30 minutes. The soaping bath is removed. Then the cotton flax yarn is rinsed with hot water at a temperature 80° C. for 20 minutes twice. Finally it is washed well. At last checking of levelling, colour fastness to washing and colour fastness to rubbing is done. The results of the checking are very well.

Example: 7

Staining Method

The raw materials for dyeing process, including.

Required pre-treated 100% cotton woven fabric

Reactive dyes: Yellow CE: 0.06% and Red CE: 0.010% on the weight of goods. Salt mixture: 1.5 GPL Sodium sulphate: 1.00 GPL Alkali agent I: 3 GPL Alkali agent II: 1.5 GPL Water Bath ratio: 1:10

Step,

A pre-treated cotton woven fabric that is dyed with salt mixture as an electrolyte and sodium chloride to provide exhaustion of dyestuff for migration and adsorption and further alkali agents I and II to provide fixation of dyestuff to the cellulose material undergoes the steps of, (i) The dye bath is maintained with an (MLR) material to liquor ratio 1:10; at pH 5.5; next added with reactive dyes and 1.5 GPL of salt mixture with 1 GPL of sodium sulphate at a temperature 50° C. and exhausted for 60 minutes.

(ii) Next added with 3 GPL of alkali agent I at a temperature 60° C. and stained for 40 minutes.

(iii) Again added with 1.5 GPL of alkali agent II at a temperature 60° C. and stained for 90 minutes.

The dye bath is removed and rinsed with warm water. After the acidic pH wash, the cotton woven fabric is rinsed with hot water at a temperature 80° C. for 20 minutes twice. Finally it is washed well. At last checking of levelling, colour fastness to washing and colour fastness to rubbing is done. The results of the checking are very well.

Example: 8

Staining Method

The raw materials for dyeing process, including

Required pre-treated 100% cotton knitted fabric

Reactive dyes: Black WNN: 6.6%, Orange CE: 0.6% and Red GF: 0.65% on the weight of goods.

Salt mixture: 3.5 GPL

Sodium chloride: 2.00 GPL

Soda ash: 25 GPL
Water Bath ratio: 1:10
Step,

A pre-treated cotton knitted fabric that is dyed with salt mixture as an electrolyte and sodium chloride to provide exhaustion of dyestuff for migration and adsorption and further soda ash to provide fixation of dyestuff to the cellulose material undergoes the steps of, (i) The dye bath is maintained with an (MLR) material to liquor ratio 1:10; at pH 5.5; next added with reactive dyes and 3.5 GPL of salt mixture with 2 GPL of sodium chloride at a temperature 50° C. and exhausted for 50 minutes.
(ii) Next added with 25 GPL of soda ash at a temperature 60° C. and stained for 90 minutes.

The dye bath is removed and rinsed with warm water. After the acidic pH wash, the cotton knitted fabric is rinsed again with 1 GPL of soaping agent at a temperature 95° C. for 30 minutes. The soaping bath is removed. Then the cotton knitted fabric is rinsed with hot water at a temperature 80° C. for 20 minutes twice. Finally it is washed well. At fast checking of levelling, colour fastness to washing and colour fastness to rubbing is done. The results of the checking are very well.

Example: 9

Staining Method
The raw materials for dyeing process, including
Required pre-treated 100% cotton yarn
Reactive dyes: Navy J B: 3.6%, Royal SLR: 0.6% and Red GF 0.65% on the weight of goods.
Salt mixture: 3.5 GPL
Sodium chloride: 2.00 GPL
Soda ash: 28 GPL
Water Bath ratio: 1:10
Step, A pre-treated cotton yarn that is dyed with salt mixture as an electrolyte and sodium chloride to provide exhaustion of dyestuff for migration and adsorption and further soda ash to provide fixation of dyestuff to the cellulose material undergoes the steps of, (i) The dye bath is maintained with an (MLR) material to liquor ratio 1:10; at pH 5.5; next added with reactive dyes and 3.5 GPL of salt mixture with 2 GPL of sodium chloride at a temperature 50° C. and exhausted for 50 minutes.
(ii) Next added with 28 GPL of soda ash at a temperature 60° C. and stained for 1:30 minutes.

The dye bath is removed and rinsed with warm water. After the acidic pH wash, the cotton yarn is rinsed again with 1 GPL of soaping agent at a temperature 95° C. for 30 minutes. The soaping bath is removed. Then the cotton yarn is rinsed with hot water at a temperature 80° C. for 20 minutes twice. Finally it is washed well. At last checking of levelling, colour fastness to washing and colour fastness to rubbing is done. The results of the checking are very well.

Example: 10

Staining Method
The raw materials for dyeing process, including
Required pre-treated linen yarn
Reactive dyes: Navy GDB: 4.0%, Red RGB: 0.3% and Yellow RGB: 0.5% on the weight of goods.
Salt mixture: 5 GPL
Sodium chloride: 2.00 GPL
Soda ash: 2 GPL
Alkali agent I: 4 GPL
Alkali agent II: 3 GPL
Water Bath ratio: 1:4
Step, A pre-treated linen yarn that is dyed with salt mixture as an electrolyte and sodium chloride to provide exhaustion of dyestuff for migration and adsorption and soda ash with alkali agent I and further alkali agent II to provide fixation of dyestuff to the cellulose material undergoes the steps of, (i) The dye bath is maintained with an (MLR) material to liquor ratio 1:4; at pH 5.5; next added with reactive dyes and 5 GPL of salt mixture with 2 GPL of sodium chloride at a temperature 50° C. and exhausted for 50 minutes.
(ii) Next added with 2 GPL of soda ash and alkali agent I: 4 GPL at a temperature 60° C. and stained for 30 minutes.
(iii) Further added with alkali agent II: 3 GPL at a temperature 60° C. and stained for 90 minutes.

The dye bath is removed and rinsed with warm water. After the acidic pH wash, the linen yarn is rinsed again with 1 GPL of soaping agent at a temperature 95° C. for 30 minutes. The soaping bath is removed. Then the linen yarn is rinsed with hot water at a temperature 80° C. for 20 minutes twice. Finally it is washed well. At last checking of levelling, colour fastness to washing and colour fastness to rubbing is done. The results of the checking are very well.

Example: 11

Staining Method
The raw materials for dyeing process, including
Required pre-treated viscose fabric
Reactive dyes: Blue HEGN: 4.6%, T Blue G: 1.0% and Red H E 3B: 0.6% on the weight of goods.
Salt mixture: 4 GPL
Soda ash: 4 GPL
Alkali agent I: 4 GPL
Alkali agent II: 3 GPL
Water Bath ratio: 1:5
Step, A pre-treated viscose fabric that is dyed with salt mixture as an electrolyte to provide exhaustion of dyestuff for migration and adsorption and soda ash with alkali agent I and further alkali agent II to provide fixation of dyestuff to the cellulose material undergoes the steps of, (i) The dye bath is maintained with an (MLR) material to liquor ratio 1:5; at pH 6.5; next added with reactive dyes and 4 GPL of salt mixture at a temperature 50° C. and exhausted for 50 minutes.
(ii) Next added with 4 GPL of soda ash and alkali agent I: 4 GPL at a temperature 60° C. and stained for 30 minutes.
(iii) Further added with alkali agent II: 3 GPL at a temperature 60° C. and stained for 90 minutes.

The dye bath is removed and rinsed with warm water. After the acidic pH wash, the viscose fabric is rinsed again with 1 GPL of soaping agent at a temperature 95° C. for 30 minutes. The soaping bath is removed. Then the viscose fabric is rinsed with hot water at a temperature 80° C. for 20 minutes twice. Finally it is washed well. At last checking of levelling, colour fastness to washing and colour fastness to rubbing is done. The results of the checking are very well.

5. BRIEF DESCRIPTION OF THE DRAWINGS

The invention will be more readily understood on reading the following descriptions with reference to the accompanying drawings in which:

FIG. 1 is a schematic diagram showing the method of dyeing in reactive dyeing consisting of salt mixture as an electrolyte with sodium chloride or sodium sulphate to exhaust the dyestuff for migration and adsorption with alkali agents I and II for fixation of the dyestuff for the treatment of pre-treated cellulose material using the salt mixture with sodium chloride or sodium sulphate at a pH 5.5, at a temperature 50° C. exhausted for 50 minutes; next using alkali agent I at a temperature 60° C., stained for 50 minutes and at last using alkali agent II at a temperature 60° C., stained for 90 minutes according to the preferred embodiment of the present invention.

Figure 2:
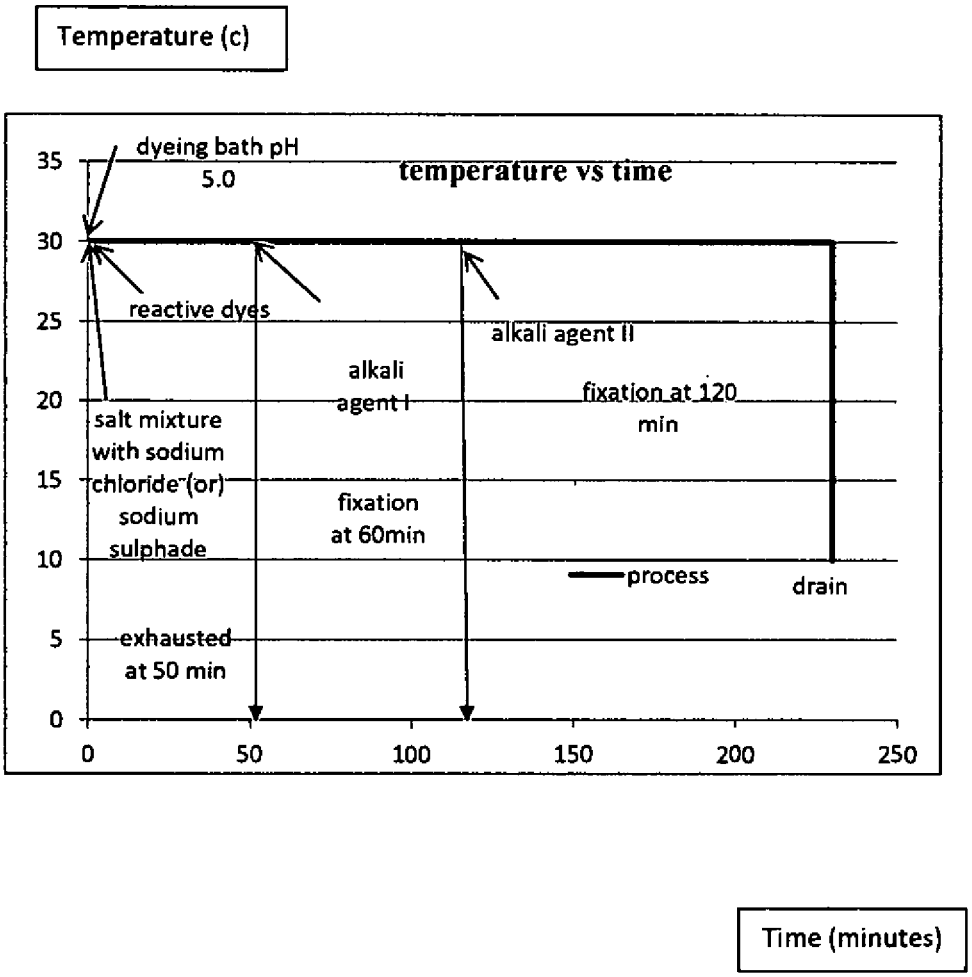

FIG. 2 is a schematic diagram showing the method of dyeing in reactive dyeing consisting of salt mixture as an electrolyte with sodium chloride or sodium sulphate to exhaust the dyestuff for migration and adsorption with alkali agents I and H for fixation of the dyestuff for the treatment of pre-treated cellulose material using the salt mixture with sodium chloride or sodium sulphate at a pH 5, at a temperature 30° C. exhausted for 50 minutes; next using alkali agent I at a temperature 30° C., stained for 60 minutes and at last using alkali agent II at a temperature 30° C., stained for 120 minutes according to the preferred embodiment of the present invention.

Figure 3:
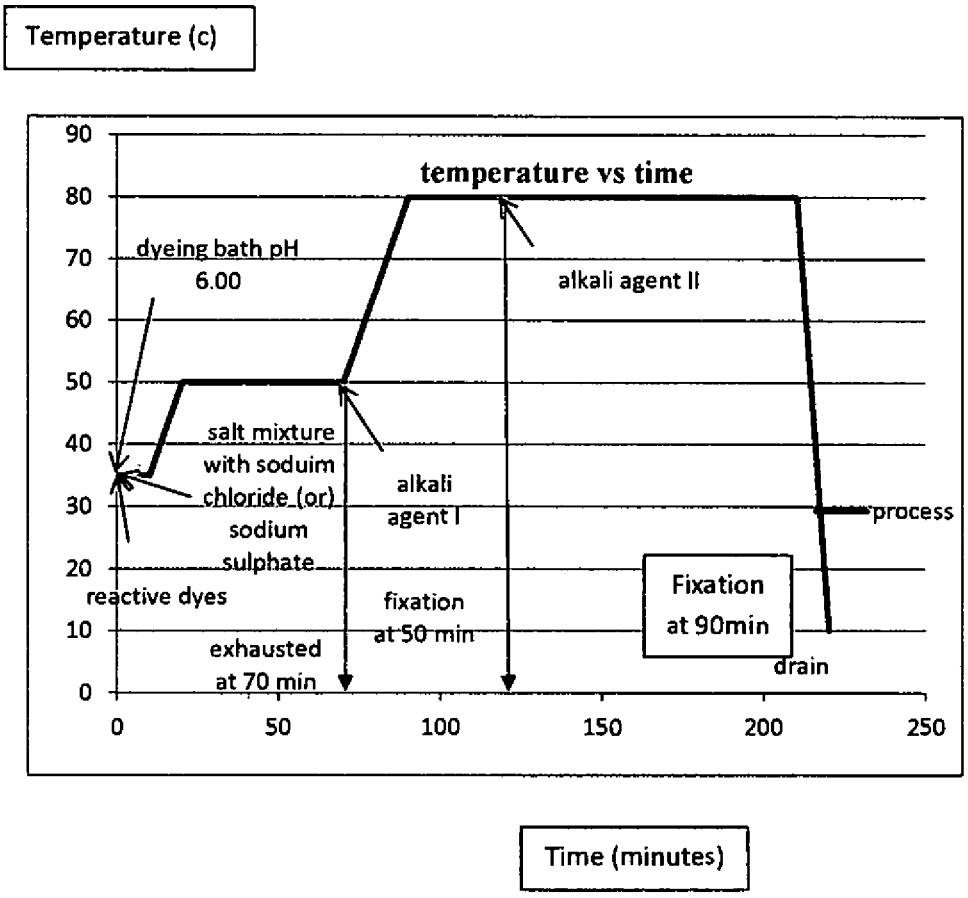

FIG. 3 is a schematic diagram showing the method of dyeing in reactive dyeing consisting of salt mixture as an electrolyte with sodium chloride or sodium sulphate to exhaust the dyestuff for migration and adsorption with alkali agents I and II for fixation of the dyestuff for the treatment of pre-treated cellulose material using the salt mixture with sodium chloride or sodium sulphate at a pH 6, at a temperature 50° C. exhausted for 50 minutes; next using alkali agent 1 at a temperature 80° C., stained for 30 minutes and at last using alkali agent II at a temperature 80° C., stained for 90 minutes according to the preferred embodiment of the present invention.

Figure 4:
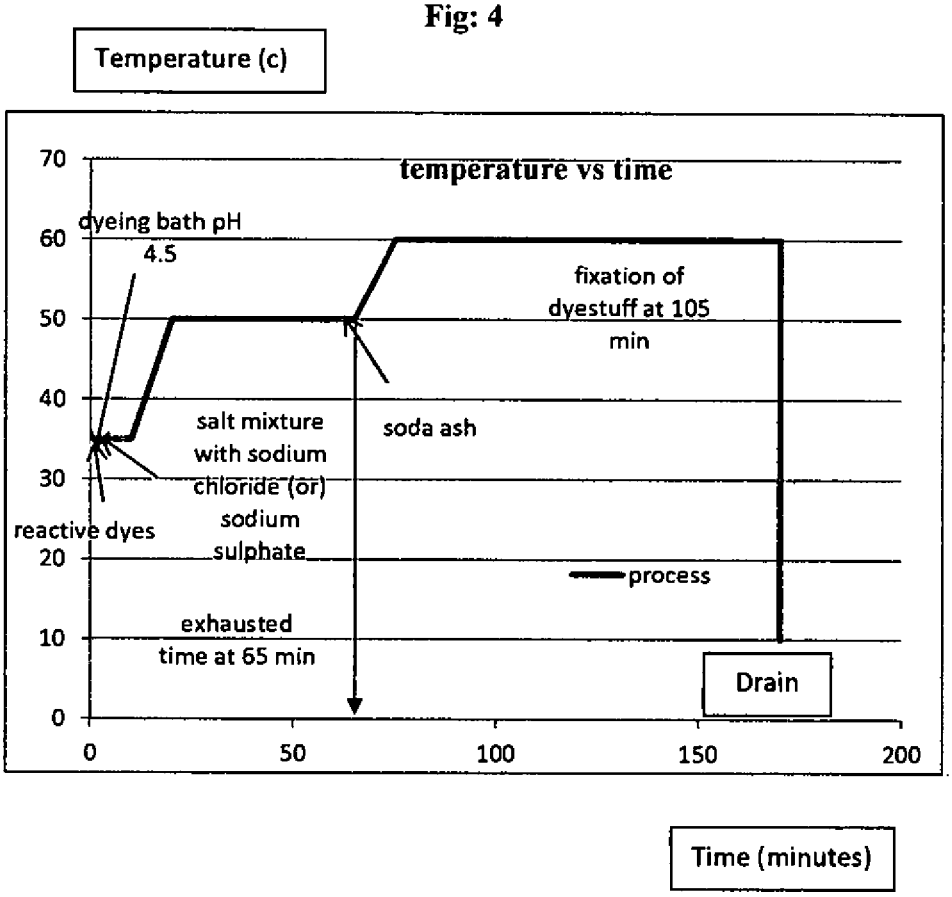

FIG. 4 is a schematic diagram showing the method of dyeing in reactive dyeing consisting of salt mixture as an electrolyte with sodium chloride or sodium sulphate to exhaust the dyestuff for migration and adsorption with alkali agents I and II for fixation of the dyestuff for the treatment of pre-treated cellulose material using the salt mixture with sodium chloride or sodium sulphate at a pH 4.5, at a temperature 50° C. exhausted for 0.45 minutes; and at last using soda ash at a temperature 60° C., stained for 90 minutes according to the preferred embodiment of the present invention.

Figure 5:
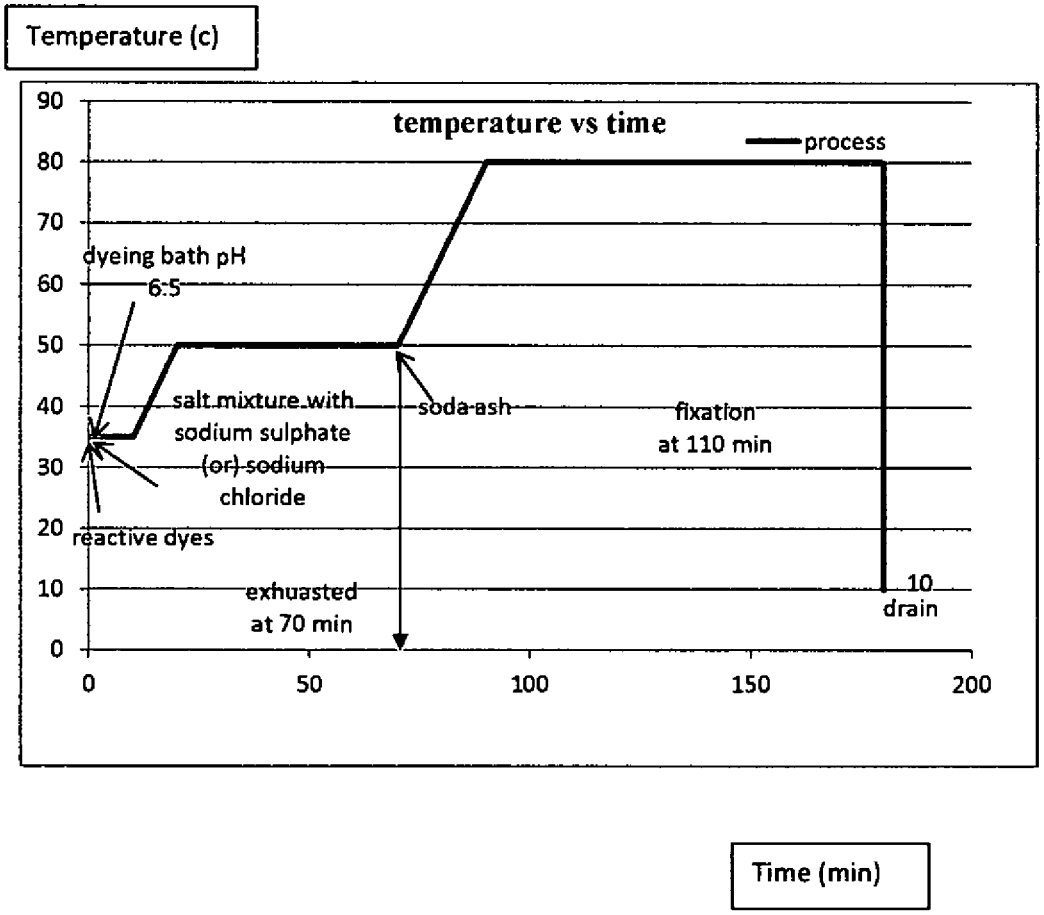

FIG. 5 is a schematic diagram showing the method of dyeing in reactive dyeing consisting of salt mixture as an electrolyte with sodium chloride or sodium sulphate to exhaust the dyestuff for migration and adsorption with alkali agents I and II for fixation of the dyestuff for the treatment of pre-treated cellulose material using the salt mixture with sodium chloride or sodium sulphate at a pH 6.5, at a temperature 50° C. exhausted for 50 minutes; and at last using soda ash at a temperature 80° C., stained for 90 minutes according to the preferred embodiment of the present invention.

Figure 6:
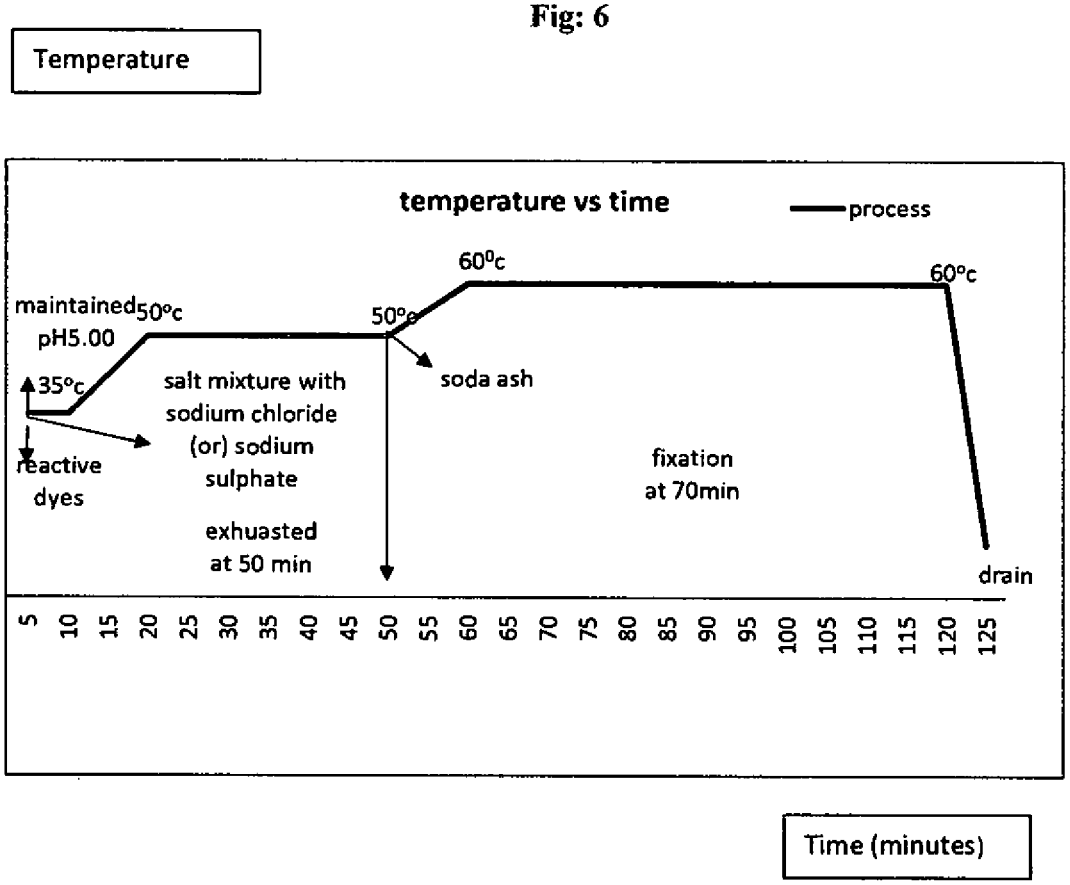

FIG. 6 is a schematic diagram showing the method of dyeing in reactive dyeing consisting of salt mixture as an electrolyte with sodium chloride or sodium sulphate to exhaust the dyestuff for migration and adsorption with alkali agents I and H for fixation of the dyestuff for the treatment of pre-treated cellulose material using the salt mixture with sodium chloride or sodium sulphate at a pH 5.00, at a temperature 50° C. exhausted for 30 minutes; and at last using soda ash at a temperature-60° C., stained for 60 minutes according to the preferred embodiment of the present invention.

Figure 7:
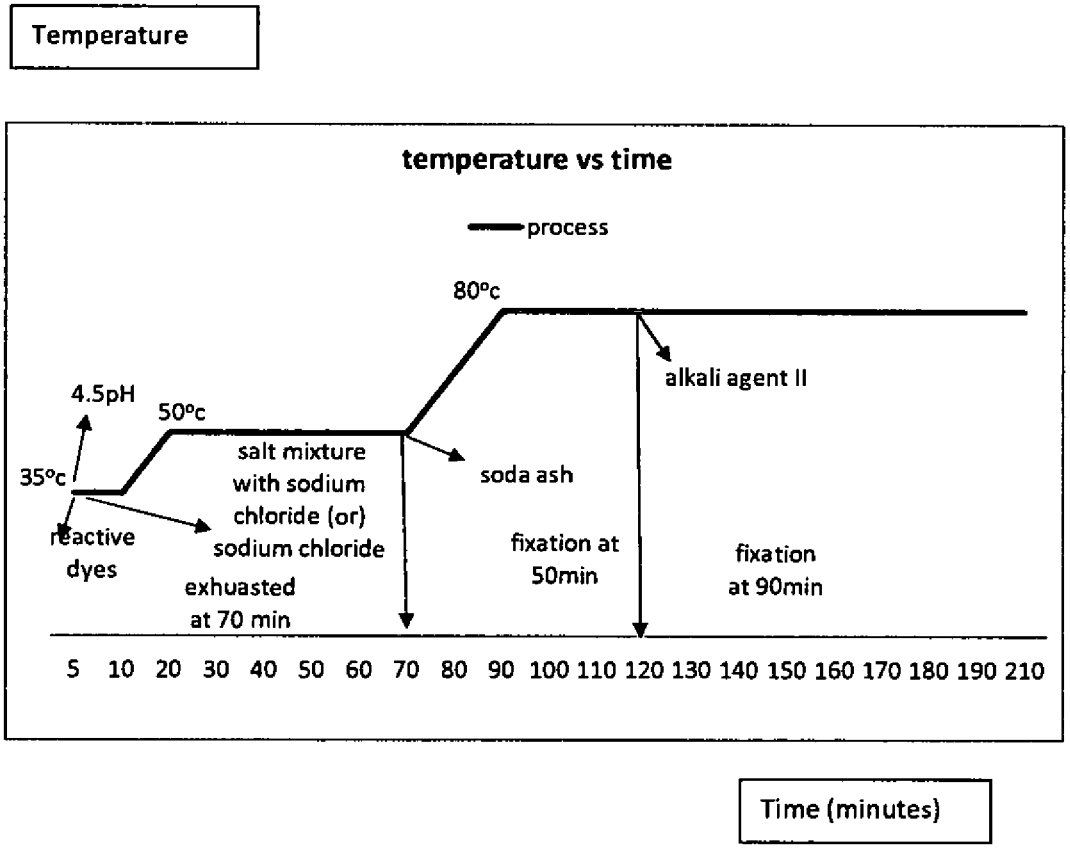

FIG. 7 is a schematic diagram showing the method of dyeing in reactive dyeing consisting of salt mixture as an electrolyte with sodium chloride or sodium sulphate to exhaust the dyestuff for migration and adsorption with alkali agents I and II for fixation. of the dyestuff for the treatment of pre-treated cellulose material using the salt mixture with sodium chloride or sodium sulphate at a pH 4.5, at a temperature 50° C. exhausted for 50 minutes; next using soda ash at a temperature 80° C., stained for 30 minutes and at last using alkali agent II at a temperature 80° C. stained for 90 minutes according to the preferred embodiment of the present invention.

Figure 8:
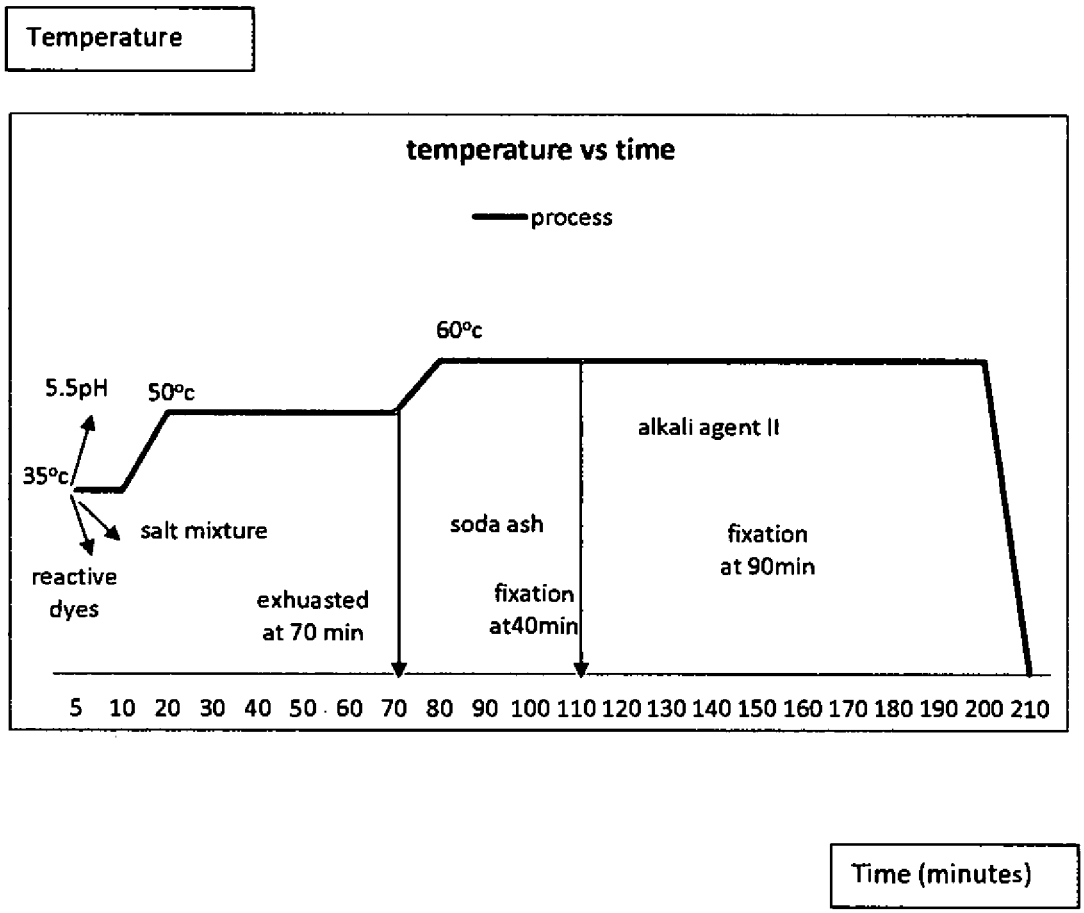

FIG. 8 is a schematic diagram showing the method of dyeing in reactive dyeing consisting of salt mixture as an electrolyte to exhaust the dyestuff for migration and adsorption with alkali agents I and II for fixation of the dyestuff for the treatment of pre-treated cellulose material using the salt mixture at a pH 5.5, at a temperature 50° C. exhausted for 50 minutes; next using soda ash at a temperature 60° C., stained for 30 minutes and at last using alkali agent II at a temperature 60° C. stained for 90 minutes according to the preferred embodiment of the present invention.

Figure 9:
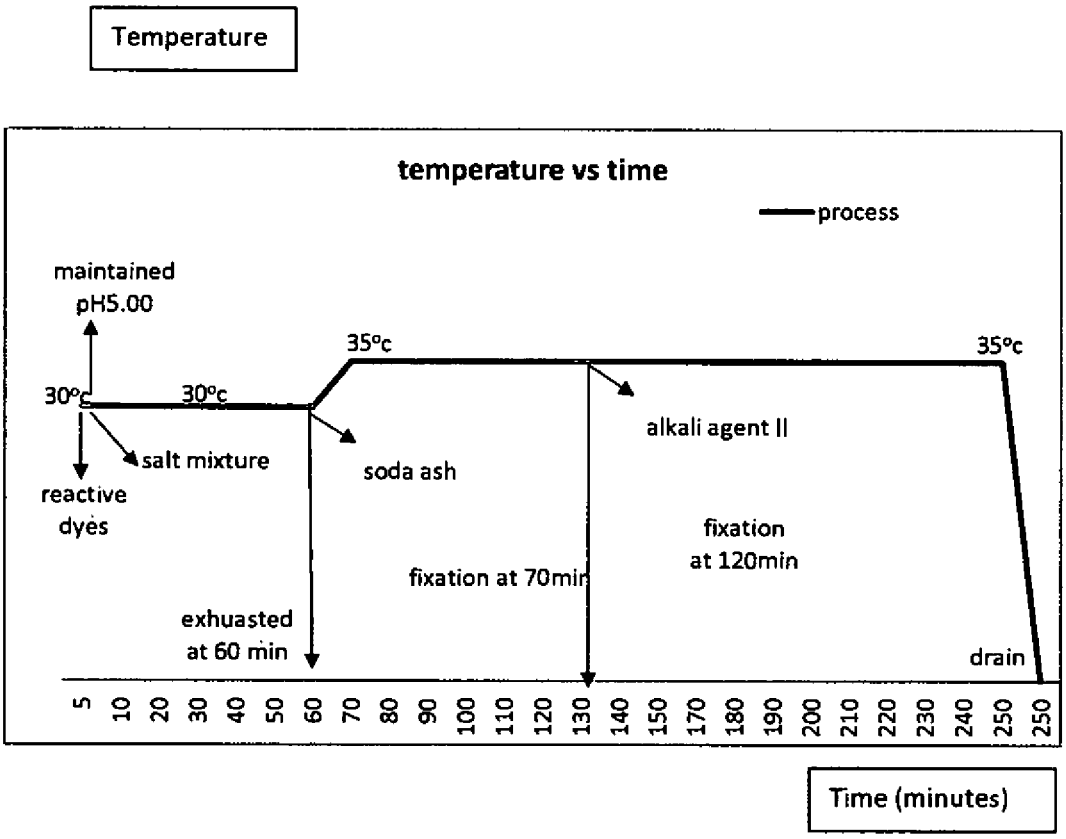

FIG. 9 is a schematic diagram showing the method of dyeing in reactive dyeing consisting of salt mixture as an electrolyte to exhaust the dyestuff for migration and adsorption with alkali agents I and II for fixation of the dyestuff for the treatment of pre-treated cellulose material using the salt mixture at a pH 5.0, at a temperature 30° C. exhausted for 50 minutes; next using soda ash at a temperature 35° C., stained for 60 minutes and at last using alkali agent II at a temperature 35° C. stained for 120 minutes according to the preferred embodiment of the present invention.

Figure 10:
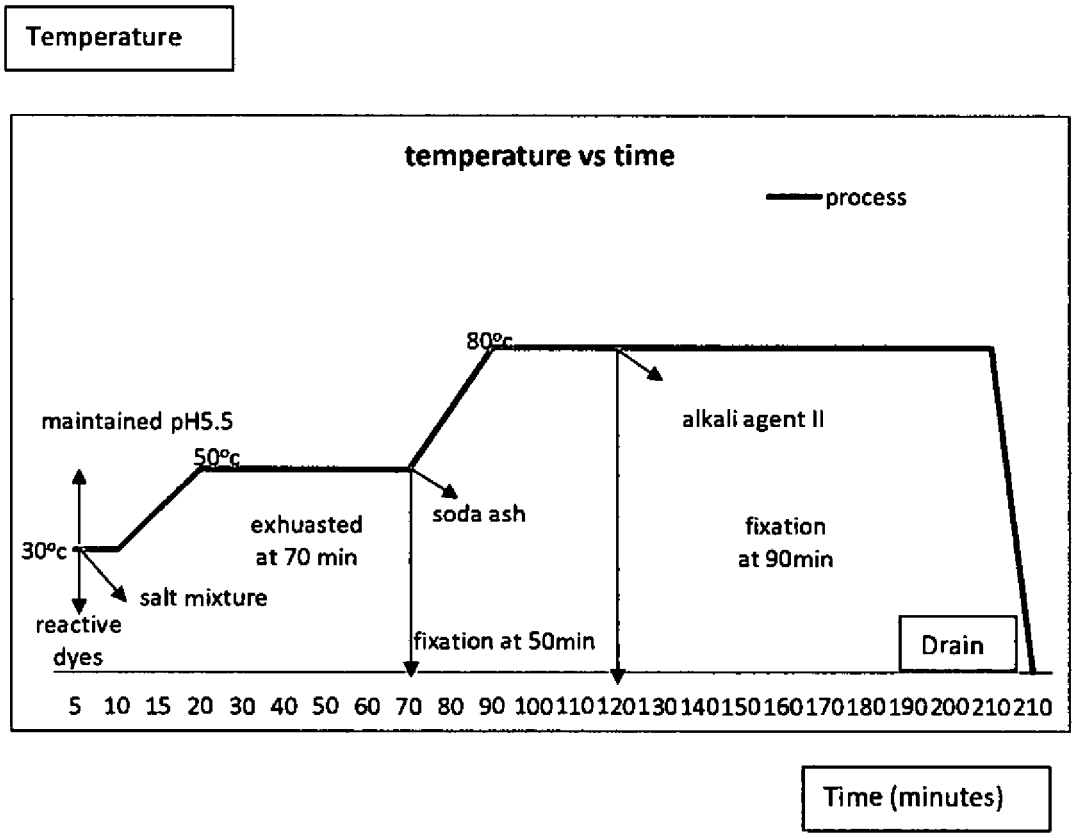

FIG. 10 is a schematic diagram showing the method of dyeing in reactive dyeing consisting of salt mixture as an electrolyte to exhaust the dyestuff for migration and adsorption with alkali agents I and II for fixation of the dyestuff for the treatment of pre-treated cellulose material using the salt mixture at a pH 5.5, at a temperature 50° C. exhausted for 50 minutes; next using soda ash at a temperature 80° C., stained for 30 minutes and at last using alkali agent II at a temperature 80° C. stained for 90 minutes according to the preferred embodiment of the present invention.

Figure 11:
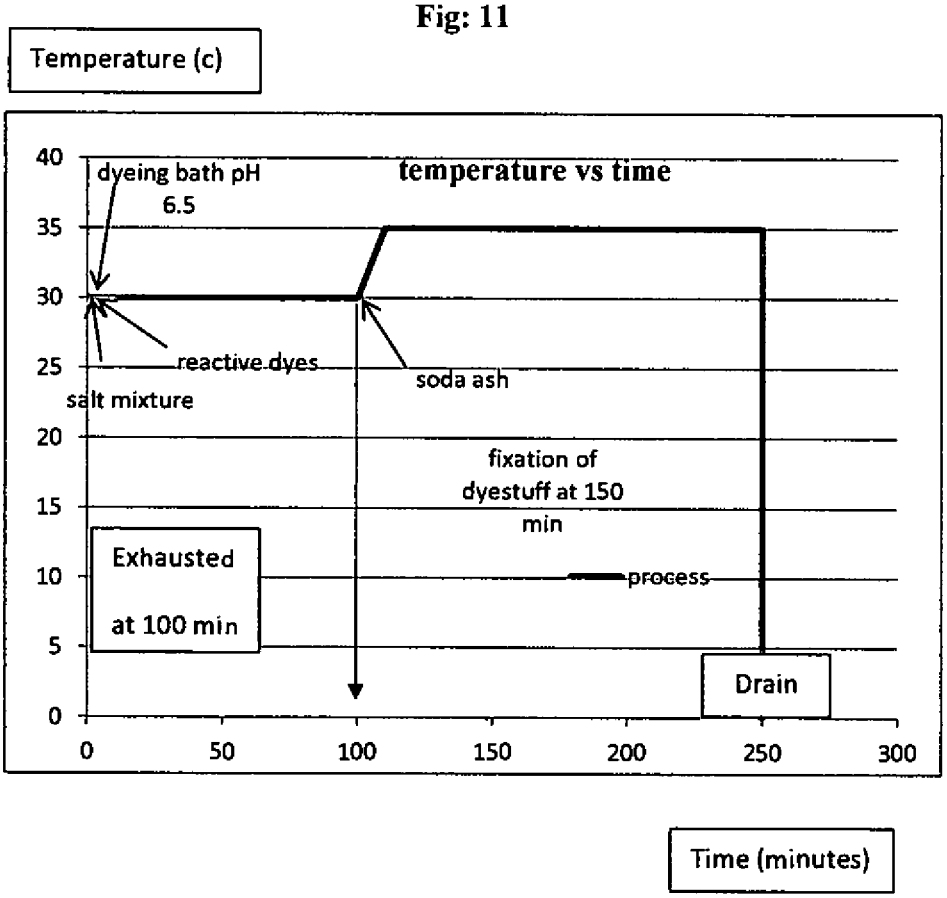

FIG. 11 is a schematic diagram showing the method of dyeing in reactive dyeing consisting of salt mixture as an electrolyte to exhaust the dyestuff for migration and adsorption with alkali agents I and H for fixation of the dyestuff for the treatment of pre-treated cellulose material using the salt mixture at a pH 6.5, at a temperature 30° C. exhausted for 100 minutes and at last using soda ash at a temperature 35° C., stained for 140 minutes according to the preferred embodiment of the present invention.

Figure 12:
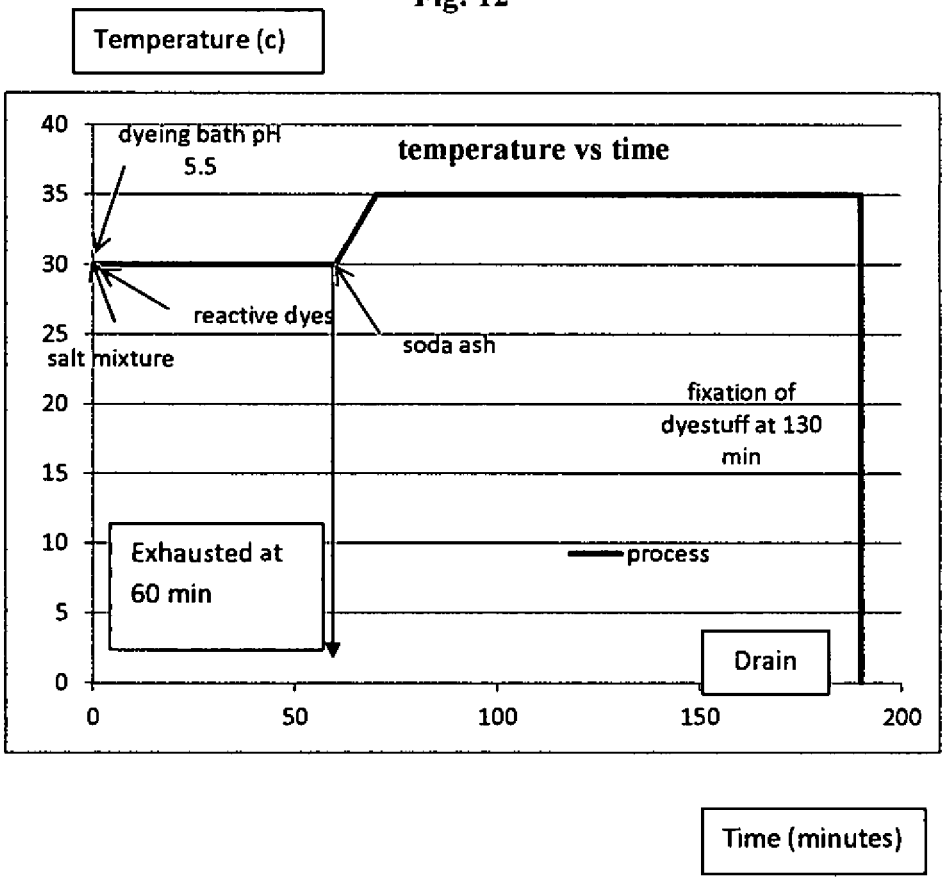

FIG. 12 is a schematic diagram showing the method of dyeing in reactive dyeing consisting of salt mixture as an electrolyte to exhaust the dyestuff for migration and adsorption with alkali agents I and H for fixation of the dyestuff for the treatment of pre-treated cellulose material using the salt mixture at a pH 5.5, at a temperature 30° C. exhausted for 60 minutes and at using soda ash at a temperature 35° C., stained for 120 minutes according to the preferred embodiment of the present invention.

The invention claimed is:

1. A method of dyeing a cellulosic material with reactive dyes using a salt mixture as an electrolyte and alkali agent I and II, the method comprising the steps of:

i. exhausting a pre-treated cellulose material with the reactive dyes using the salt (weight percentage of content basis) first mixture of:

A. potassium chloride between 2% and 50%,

B. diammonium phosphate between 0.5% and 18%,

C. urea between 0.9% and 60%,

D. sodium nitrate between 2.00% and 30%,

E. calcium chloride between 0.02% and 7%,

F. manganese sulphate between 0.10% and 5%,

G. ETDA sodium between 0.002% and 7% and

H. ferrous sulphate between 0.10% and 10%, wherein the first mixture is added to water in an amount ranging between 0.2 and 5 GPL (gram per litre), followed by adding sodium chloride or sodium sulphate in an amount ranging from 0.5 to 5 gram per litre in a reactive dyeing to obtain an exhausted cellulose material;

ii. fixing the exhausted cellulose material by using the alkali agent I comprising (weight percentage of content basis) a second mixture of:

A. sodium bicarbonate between 2% and 40%,

B. potassium bicarbonate between 0.5% and 15%,

C. sodium carbonate between 10% and 90%,

D. potassium carbonate between 2% and 70%,

E. sodium acetate between 2% and 30%,

F. ferrous sulphate between 0.1% and 5%, and water, wherein the second mixture is added to water in an amount ranging between 0.5 and 15 GPL (gram per litre); or by using soda ash (sodium carbonate) in an amount between 1 GPL and 33 GPL (gram per liter);

iii. treating the cellulosic material of step (ii) to further, fixation of the dyestuff using the alkali agent II comprising (weight percentage of content basis) a third mixture of:

A. potassium hydroxide between 5% and 70%,

B. calcium hydroxide between 1% and 50%,

C. trisodium phosphate between 2% and 80%,

D. sodium hydroxide between 0.1% and 20%, and water, wherein the third mixture is added to water in an amount ranging between 0.2 and 10 GPL (gram per litre) to obtain a stained cellulosic material;

(iv) subjecting the stained cellulosic material to neutralization, soaping, washing with water and drying to obtain a dried dyed cellulosic material, wherein:

the exhausting step (i) is carried out by maintaining pH 3 and above at a temperature in a range of 25-80° C. and an (MLR) material to liquor ratio is in a range of 1:20 to 1:3 for a time period of between 15 minutes and 90 minutes;

the fixing step (ii) is carried out by maintaining pH 9.5 and above at a temperature between 25° C. and 80° C. for a time period of between 10 minutes and 90 minutes; and the fixing step (iii) is carried out by maintaining pH between 10 and above at a temperature between 25° C. and 80° C. for a time period of between 40 minutes and 150 minutes.

2. The method of claim 1, wherein the reactive dye(s) is selected from the group consisting of chlorotriazine dyes MCT), vinyl sulphone dyes (VS), heterocylic halogen containing dyes (HHC), dye mixtures, and bi and poly-functional reactive dye (MCT-VS).

3. The method of claim 1, wherein the step (ii) is using soda ash (sodium carbonate) in an amount between 1 GPL and 33 GPL (gram per litre).

* * * * *